US006307426B1

(12) United States Patent
Ricotti et al.

(10) Patent No.: US 6,307,426 B1
(45) Date of Patent: Oct. 23, 2001

(54) LOW VOLTAGE, BAND GAP REFERENCE

(75) Inventors: Giulio Ricotti, Broni; Domenico Rossi, Cilavegna, both of (IT)

(73) Assignee: SGS-Thomson Microelectronics S.r.l., Agrate Brianza (IT)

( * ) Notice: Subject to any disclaimer, the term of this patent is extended or adjusted under 35 U.S.C. 154(b) by 1150 days.

(21) Appl. No.: 08/706,978

(22) Filed: Sep. 3, 1996

Related U.S. Application Data

(63) Continuation of application No. 08/358,159, filed on Dec. 16, 1994, now abandoned.

(30) Foreign Application Priority Data

Dec. 17, 1993 (EP) ..... 93830512

(51) Int. Cl.[7] ..... G05F 3/04
(52) U.S. Cl. ..... 327/543; 323/313
(58) Field of Search ..... 323/313, 314, 323/315, 316; 327/538, 539, 540, 545

(56) References Cited

U.S. PATENT DOCUMENTS

| | | | | |
|---|---|---|---|---|
| 3,617,859 | | 11/1971 | Dobkin et al. . | |
| 4,319,180 | * | 3/1982 | Nagano | 323/313 |
| 4,524,318 | | 6/1985 | Burnham et al. . | |
| 4,525,663 | * | 6/1985 | Henry | 323/315 |
| 4,902,915 | * | 2/1990 | Tran | 327/539 |
| 5,086,238 | * | 2/1992 | Watanabe et al. | 327/539 |
| 5,087,830 | * | 2/1992 | Cave et al. | 327/539 |
| 5,105,145 | * | 4/1992 | Neth | 323/316 |
| 5,125,112 | | 6/1992 | Pace et al. . | |
| 5,394,026 | * | 2/1995 | Yu et al. | 327/536 |
| 5,410,241 | * | 4/1995 | Cecil | 323/312 |
| 5,440,224 | * | 8/1995 | Kimura | 323/313 |

FOREIGN PATENT DOCUMENTS

| | | | | |
|---|---|---|---|---|
| 483 913 | | 11/1990 | (EP) . | |
| WO 81/02348 | * | 8/1981 | (WO) | 327/539 |

OTHER PUBLICATIONS

Gray, "Analysis and Design of Analog Integrated Circuits", 1977. pp. 254–261.*

Made Gunawan, et al., A Curvature–Corrected Low–Voltage Bandgap Reference, IEEE Journal of Solid–State Circuits, vol. 28, No. 6, Jun. 6, 1993, pp. 667–670.

* cited by examiner

*Primary Examiner*—Terry D. Cunningham
(74) *Attorney, Agent, or Firm*—Lisa K. Jorgenson; Allen, Dyer, Doppelt, Milbrath & Gilchrist, P.A.

(57) ABSTRACT

A voltage, replica of the difference between two dissimilar base-emitter voltages in the form of an intrinsic input offset voltage of a differential input pair of transistors of a noninverting, buffer-configured operational amplifier, is summed with a pre-established fraction of a base-emitter voltage, to produce a voltage reference without thermal drift of a level that can be as low as few 10 mV. The intrinsic input offset voltage is controlled by a local feedback loop acting on the bias current that is forced through the input pair of transistors that may be realized with a certain area ratio. The relatively simple circuit is useful in battery operated, low supply voltage, systems.

22 Claims, 3 Drawing Sheets

LOW VOLTAGE, BAND GAP REFERENCE

CROSS-REFERENCE TO RELATED APPLICATION

This application is a continuation of application Ser. No. 08/358,159 filed Dec. 16, 1994 and now abandoned.

This application claims priority from EP 93830512.5, filed Dec. 17, 1993, which is hereby incorporated by reference.

BACKGROUND AND SUMMARY OF THE INVENTION

The present invention relates to a method and a circuit for generating a reference voltage without thermal drift and of relatively low value, i.e. markedly lower than the voltage of a base-emitter junction (Vbe).

In many systems and particularly in monolithically integrated systems, it is necessary to implement voltage references, that is circuits capable of generating a stable reference voltage, free of thermal drift. Commonly this is achieved by employing a so-called band-gap circuit. A band-gap circuit produces a voltage corresponding to the sum of one or several base-emitter voltages (Vbe), as of common bipolar junction transistors, and of a voltage proportional to the difference between two different base-emitter voltages, suitably amplified by a certain amplification factor K, so as to make the amplified difference voltage comparable with the voltage of one or several base-emitter junctions, in order to produce a desired reference voltage given by:

$$Vref=Vbe+K\delta Vbe, \text{ where } K>1.$$

The ΔVbe term that is employed for compensating the thermal drift of a certain sign of the particular Vbe or sum of Vbe used, may suitably assume a thermal coefficient of opposite sign of the thermal coefficient of the Vbe term used. Therefore, the resulting reference voltage Vref that is produced may be stable in terms of temperature variations.

Commonly band-gap circuits produce a temperature compensated voltage Vref greater or equal to about 1.2V. On the other hand, in systems designed for operating with relatively low supply voltages, for example in battery powered portable instruments and apparatuses, the supply voltage may be relatively low, for example in the vicinity of 1.0V. This makes a correct operation of a normal band-gap circuit impossible.

Recently, a band-gap reference voltage generating circuit has been proposed which is capable of providing a regulated voltage of relatively low level, in the vicinity of 200 mV, which may be adjusted upward to higher levels. This makes the voltage reference circuit suitable also in battery powered systems with a supply voltage of just 1V. The circuit is described in the article entitled: "A Curvature-Corrected Low-Voltage Bandgap Reference", by Gunawan, Meijer, Fonderie, and Huijsing, 28 IEEE JOURNAL OF SOLID STATE CIRCUITS 667–670 (1993), the content of which is herein incorporated by express reference.

Such a known circuit adopts a compensating system of the nonlinearity of the temperature characteristics of a base-emitter junction (Vbe). Basically, the circuit employs a first circuit block for generating a current proportional to the absolute temperature (PTAT) and a second circuit block capable of generating a current proportional to a Vbe, plus a correction current for compensating the nonlinearity of the temperature coefficient of the Vbe. Thereafter, the sum of the two currents is converted to a voltage signal which is amplified by an output buffer. The circuit is relatively complex and generates a stabilized reference voltage of about 200 mV, with a supply voltage that may be as low as about 1V.

There remains a need or utility for a circuit capable of generating a reference voltage of a relatively low value (on the order of a few tens of mV) without thermal drift, which is relatively simple to realize.

This objective is fully met by the method and the circuit object of the present invention.

Basically, the method of the invention rests on the generation of a stabilized voltage in the form of a sum of a voltage equivalent to the difference between two different base-emitter voltages, which is advantageously represented by a suitably controlled intrinsic offset voltage of a pair of transistors that constitute an input differential stage of a buffer-configured, operational amplifier, and a preestablished fraction of a base-emitter junction voltage. A subdivision of a Vbe voltage is implemented by mirroring, in a certain ratio, a current proportional to a Vbe voltage and by converting the divided-down mirrored current into a divided-down Vbe voltage on a resistance. The voltage difference between two different base-emitter junction voltages to be summed with the divided-down portion of a Vbe voltage, in order to compensate in terms of temperature the resulting voltage sum, is obtained in the form of an intrinsic offset voltage, controlled through a local feedback loop, of a differential pair of transistors that form an input stage of an operational amplifier that practically works as an output buffer of the stabilized voltage produced by the circuit.

The stabilized voltage sum that can be generated by the circuit may be of several tens of milliVolts and may be freely scaled-down by the use of a resistive voltage divider.

The circuit may be powered with a voltage of about 1V without jeopardizing its operation. Therefore the circuit is particularly useful in low voltage, battery powered systems.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

Figure 1:
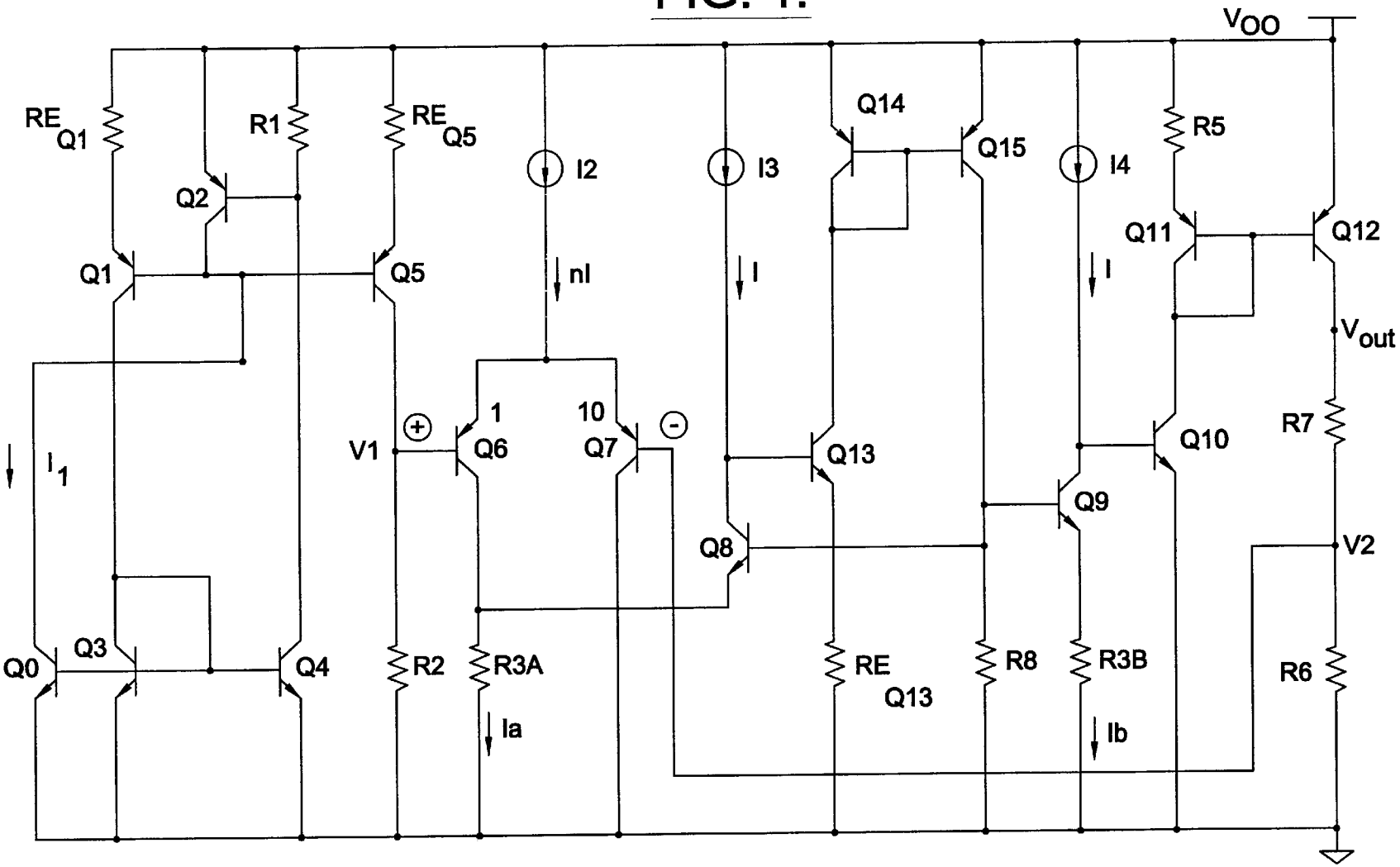
FIG. 1 is a diagram of a circuit for generating a reference voltage, according to the present invention.

The numerous innovative teachings of the present application will be described with particular reference to the presently preferred embodiment (by way of example, and not of limitation), in which:

With reference to FIG. 1, the portion on the circuit of the left-hand side of the node V1 will be discussed first.

The bipolar junction transistor (BJT) Q2 generates a current I given by the ratio between its base-emitter voltage Vbe and the resistance R1: $I=Vbe_{Q2}/R1$.

A suitable start-up circuit may comprise, as shown, a current generator I1, which in practice may be constituted by a transistor Q0 of an appropriate size. As a matter of fact, a so-called start-up circuit is necessary in order to ensure that, at the turn-on instant, the local loop reaches a self-sustaining condition.

To a first approximation, the base current of the BJT Q2 under equilibrium conditions, will be given by: $Ic_{Q2}$=I1. This condition will then be maintained stable by the local feedback loop. However, at the turn-on instant, Q2 is still off and will turn-on only when $Ic_{Q4}$=$Vbe_{Q2}$/R1. Therefore, the collector voltage of Q2 will tend to drop until Q1 (which triggers the feedback) turns on thus supplying a current to Q3, which current, mirrored by Q4, drives the base of Q2. This driving current of the BJT Q2 will continue to increase until the following relationships hold:

$$Ic_{Q1}=Ic_{Q3}=Ic_{Q4}=Vbe_{Q2}/R1.$$

The transistor Q5, having the same area as Q1, will also conduct a current given by: $Ic_{Q5}$=$Vbe_{Q2}$/R1, which will be forced on R2, thus producing the voltage signal V1. The resistances $RE_{Q1}$ and $RE_{Q5}$, which should be equal, serve for degenerating the respective current generators Q1 and Q5. Therefore, a fraction of the $Vbe_{Q2}$ voltage, given by $$V1=Vbe_{Q2}*R2/R1$$

is obtained, wherein the coefficient K=R2/R1 may be fixed according to needs.

Figure 2:
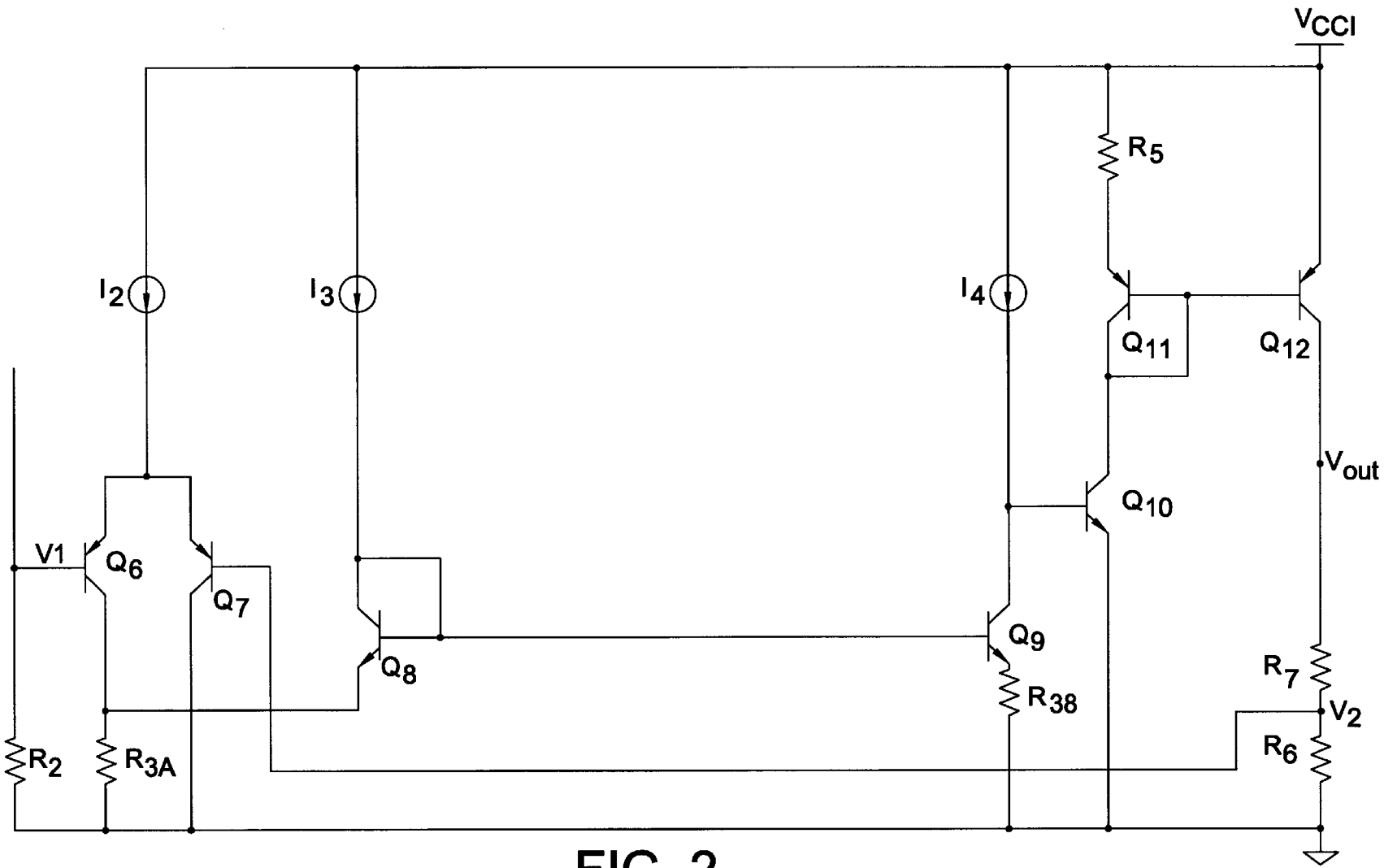
FIG. 2 is a partial, simplified circuit diagram of the circuit of FIG. 1, which emphasizes some essential aspects of the circuit of the invention.

Such a divided-down portion V1 of a base-emitter junction voltage ($Vbe_{Q2}$), as shown in FIGS. 1 and 2, is applied to the base of a first transistor Q6 of a differential input pair composed of Q6 and Q7, which practically represents a noninverting input of an operational amplifier, configured as a noninverting buffer. The inverting input of the amplifier, represented by the base node of the Q7 transistor of the differential input pair, is connected to an intermediate node (V2) of a resistive voltage divider R7-R6 of the output voltage produced by the operational amplifier.

An analysis of the operation of the circuit of the invention will be rendered more easily by momentarily referring to the partial and simplified circuit diagram of FIG. 2.

Concisely, the transistor pair, Q6–Q7, and the generator 12 form a differential input stage. The transistor Q10 and its load, constituted by a diode-configured transistor Q11 and by a resistance R5, constitute an amplifying stage (coupled to $R_{3A}$ by a stage including $Q_8$ and $Q_9$), while the transistor Q12 constitutes an output stage of the operational amplifier.

The amplifier is configured as a noninverting buffer by means of a feedback line constituted by the resistance R7, connected between the output node (Vout) of the amplifier and its inverting input, that is the base node of the transistor Q7 of the input differential pair, and by the resistance R6 connected between the noninverting input and ground.

As already said above, the effectiveness of the voltage reference circuit resides on the fact that the thermal drift of a certain sign of the divided-down portion V1 of a Vbe voltage, is counterbalanced by a thermal drift of opposite sign of a ΔVbe term (i.e. a voltage difference between two different Vbe voltages), in order to ensure that the resulting sum voltage (V2) has a substantially null temperature coefficient (or thermal drift).

To obtain a ΔVbe term to be summed with the divided-down voltage V1 in order to obtain a resulting sum voltage that is temperature stable, the circuit of FIG. 1 advantageously uses an intrinsic offset voltage of the input pair of transistors Q6 and Q7 that form the input differential stage of the operational amplifier. A certain intrinsic offset voltage may be created by appropriately making the two transistors Q6 and Q7 that form the input differential pair with different emitter areas. Moreover, the offset voltage is controlled through a dedicated control loop of the bias current that is forced through the input pair of transistors.

By referring to the functional diagram of FIG. 2, such a control loop (local feedback) of the bias current forced through the input pair of transistors Q6 and Q7 is implemented by the transistors Q8 and Q9, by the respective current generators 13 and 14 and by the resistances R3A and R3B.

By assuming negligible (in first approximation) the base current absorbed by the transistor Q10 and, for example, realizing Q8 and Q9 with identical emitter areas and forcing through Q8 and Q9 an identical current by the use of identical generators I3 and I4, each capable of generating a current I, the transistors Q8 and Q9 will assume an identical Vbe. This, coupled with the fact that the respective bases are connected in common, implies that the emitter voltage of Q8 is identical to the emitter voltage of Q9. This in turn permits to establish a certain current Ib through R3B and a certain current Ia through R3A, which will have the same ratio (i.e. 1:2) of the value of the resistances R3B and R3A. As may be observed, the current Ia that flows through R3A contains also a contribution coming from the collector of Q6.

Moreover, by assuming that the current generator 12 of the input differential stage generates a current nI, it is evident that the control loop fixes a certain collector current of the input transistor Q6 and, as a consequence, the collector current of the other transistor Q7 of the input differential pair will also be fixed by the local feedback loop, at the value given by the following expression:

$$Ic_{Q7}=nI-I=(n-1)I \tag{1}$$

By applying Kirchoff's law, $$V2=V1+Vbe_{Q6}-Vbe_{Q7} \tag{2}$$

$$=Vbe\frac{R2}{R1}+\frac{KT}{q}\ln\left(\frac{I_{c6}}{Ae_{Q6}I_S}\right)-\frac{KT}{q}\ln\left(\frac{I_{c7}}{Ae_{Q7}I_S}\right) \tag{3}$$

$$=Vbe\frac{R2}{R1}+\frac{KT}{q}\ln\left(\frac{I}{(n-1)I}\right)\frac{Ae_{Q7}}{Ae_{Q6}} \tag{4}$$

It may be observed from the above indicated expressions, that the difference between the respective Vbe voltages of the transistors Q6 and Q7 may, in function of the ratio between their respective emitter areas, $Ae_{Q7}/Ae_{Q6}$, assume a temperature coefficient that can be either negative or positive and suitable for compensating the temperature coefficient of a certain sign possessed by the divided-down voltage V1.

In the depicted example, the divided-down voltage V1 has a negative temperature coefficient and therefore the intrinsic offset voltage of the differential pair Q6–Q7 must have a positive temperature coefficient. This is achieved by making the transistor Q7 with an emitter area that is sufficiently larger than the emitter area of Q6. Moreover, it is clear that by adjusting the emitter area ratio of the transistors Q6 and Q7 and/or the ratio between R3 and R2, a stabilized voltage V2 may be obtained such that: δV2/δT=0.

In the circuit diagram of FIG. 1, Q13, Q14, Q15, $RE_{Q1}$3 and R8 constitute a circuit that, through the local feedback, is capable of configuring substantially as a diode the transistor Q8, which, together with Q9, "reads" the differential stage Q6–Q7. The signal amplified by Q10 is transferred through the current mirror Q11 and Q12 to the output node Vout, and the resistances R7 and R6 close the general feedback loop, by feeding back the V2, voltage present on the intermediate node to the base of Q7 of the input differential stage. (The ratio of R7/R6 is selected to get the desired output voltage $V_{out}$=V2·R7/R6.)

EXAMPLE

By assuming a $Vbe_{Q2}$=600 mV, with a temperature coefficient of $\delta Vbe_{Q2}/\delta T$=−2 mV/° C., and a partition ratio given by R2/R1=0.1, a divided-down voltage is obtained that is given by: V1=$Vbe_{Q2}$R2/R1=60 mV, having a thermal coefficient of: δV1/δT=−2 mV/° C. By assuming n=2, $Ae_{Q7}$=10 and $Ae_{Q6}$=1, the following is obtained:

$$\Delta Vbe = Vbe_{Q6} - Vbe_{Q7} = 60 \text{ mV}$$

and $$\delta \Delta Vbe/\delta T = +0.2 \text{ mV/° C.}$$

Therefore, the circuit is capable of generating a stabilized voltage: V2=120 mV, with δV2/δT≈0.

In this example, the voltage drop across R3A and R3B must be maintained equal to or lower than about 200 mV, in order to ensure that the differential pair of transistors Q6–Q7 may function correctly without saturating.

Figure 3:
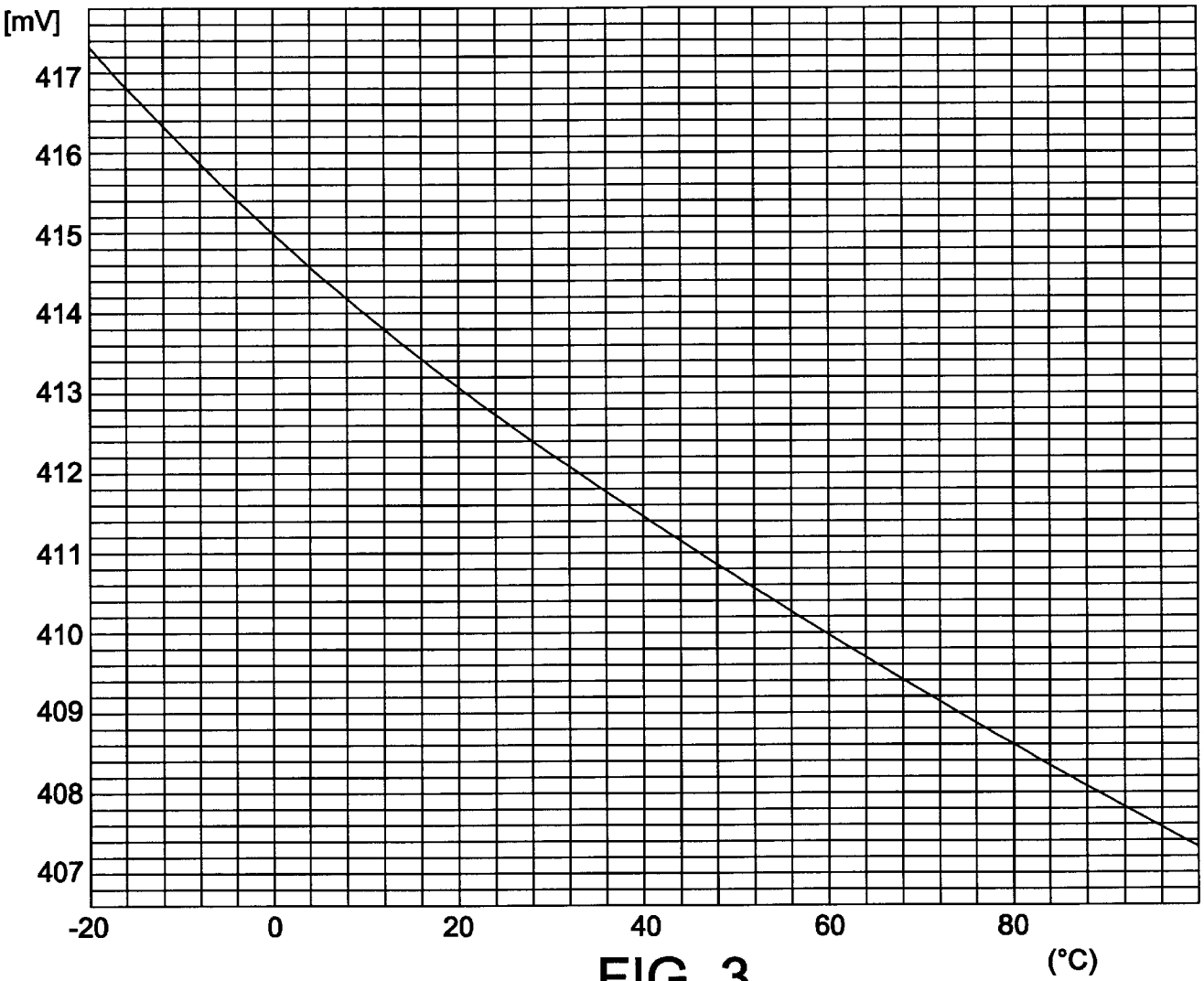
FIG. 3 shows a voltage-temperature characteristic of a circuit made according to the present invention.

The characteristic of a circuit made in accordance with the present invention is shown by the stabilized voltage V2 versus temperature curve of FIG. 3. In such an embodiment, without any correction stages, the output voltage V2 has a temperature coefficient that can be calculated as:

$$\delta V2/\delta° \text{ C.} = -0.0833 \text{ mV/° C.}$$

As will be recognized by those skilled in the art, the innovative concepts described in the present application can be modified and varied over a tremendous range of applications, and accordingly the scope of patented subject matter is not limited by any of the specific exemplary teachings given. For example, as will be obvious to those of ordinary skill in the art, other circuit elements can be added to, or substituted into, the specific circuit topologies shown. For another example, the circuit of the operational amplifier may be realized in a form different from the one depicted in the figures and described above. In particular, stages for correcting the "curvature" of the bandgap characteristic may be added by employing a correction technique similar to the one described in the Gunawan et al. article cited above.

What is claimed is:

1. A circuit for generating a temperature stable reference voltage, said circuit comprising:

a first circuit comprising a first bipolar transistor, and connected to provide as output a first voltage equivalent to a constant fraction, which is less than unity, of the base-emitter voltage of said first bipolar transistor;

an operational amplifier, configured as a noninverting buffer, and operatively connected to receive said first voltage and to produce a control voltage equal to the sum of said first voltage and a predefined and controlled intrinsic offset voltage of a differential input pair of transistors of said operational amplifier and said temperature stabilized reference voltage, which is proportional to said control voltage, a first one of said differential input pair of transistors having an emitter area different from a second one of said differential input pair of transistors; and said operational amplifier having a feedback loop for controlling a bias current forced through said input pair of transistors.

2. The circuit of claim 1, wherein said first circuit comprises a current mirror connected to drive said first transistor, and to force a current through a resistance, on which said first voltage is produced.

3. The circuit of claim 1, wherein said first voltage is applied to the base of a first transistor of said differential input pair; and wherein a control resistance is connected between a collector of said first transistor of said differential input pair and ground; and wherein said control voltage, which is present on an intermediate node of a voltage divider of said operational amplifier connected between said output voltage and ground, being applied to the base of said second transistor of said differential input pair.

4. A circuit for generating a temperature stable reference voltage, said circuit comprising:

a first circuit comprising a first bipolar transistor, and connected to provide as output a first voltage equivalent to a constant fraction, which is less than unity, of the base-emitter voltage of said first bipolar transistor;

an operational amplifier, configured as a noninverting buffer, and operatively connected to receive said first voltage and to produce a control voltage equal to the sum of said first voltage and a predefined and controlled intrinsic offset voltage of a differential input pair of transistors of said operational amplifier and said temperature stabilized reference voltage, which is proportional to said control voltage, a first one of said differential input pair of transistors having an emitter area different from a second one of said differential input pair of transistors; and said operational amplifier having a feedback loop for controlling a bias current forced through said input pair of transistors;

wherein said first voltage is applied to the base of a first transistor of said differential input pair;

wherein a control resistance is connected between a collector of said first transistor of said differential input pair and ground;

wherein said control voltage, which is present on an intermediate node of a voltage divider of said operational amplifier connected between said output voltage and ground, being applied to the base of said second transistor of said differential input pair; and wherein said feedback loop comprises a current mirror capable of forcing a pre-established current through said control resistance.

5. A circuit for generating a temperature stable reference voltage, said circuit comprising:

a first circuit comprising a first bipolar transistor, and connected to provide as output a first voltage equivalent to a constant fraction, which is less than unity, of the base-emitter voltage of said first bipolar transistor;

an operational amplifier, configured as a noninverting buffer, and operatively connected to receive said first voltage and to produce a control voltage equal to the sum of said first voltage and a predefined and controlled intrinsic offset voltage of a differential input pair of transistors of said operational amplifier and said temperature stabilized reference voltage, which is proportional to said control voltage, a first one of said differential input pair of transistors having an emitter area different from a second one of said differential input pair of transistors; and said operational amplifier having a feedback loop for controlling a bias current forced through said input pair of transistors;

wherein said first voltage is applied to the base of a first transistor of said differential input pair; and wherein a control resistance is connected between a collector of said first transistor of said differential input pair and ground; and wherein said control voltage, which is present on an intermediate node of a voltage divider of said operational amplifier connected between said output voltage and ground, being applied to the base of said second transistor of said differential input pair;

wherein said feedback loop comprises a current mirror capable of forcing a pre-established current through said control resistance;

wherein said current mirror comprises an amplifying stage, which drives an output stage of the amplifier.

6. A method for generating a small reference voltage without thermal drift, comprising the steps of:

(a.) generating a first voltage which is a pre-established fraction of a base-emitter junction voltage of a bipolar transistor;

(b.) deriving a ΔVbe voltage, which corresponds to the difference between Vbe voltages of two transistors with different current densities, and (c.) producing a voltage proportional to the sum of said ΔVbe and said first voltage to produce an output signal.

7. The method of claim 6, wherein, in said step (b.), said two transistors form a differential input pair of transistors of a noninverting, buffer-configured, operational amplifier, of which said ΔVbe voltage is an intrinsic input offset voltage; and wherein said offset voltage is controlled by a local feedback loop of a bias current forced through said two transistors.

8. The circuit of claim 1, wherein said first bipolar transistor is pnp.

9. The circuit of claim 1, wherein said first bipolar transistor and said differential input pair of transistors have a same conductivity type.

10. The circuit of claim 1, wherein said differential input pair of transistors includes two pnp transistors.

11. A circuit for generating a temperature stable reference voltage, comprising:

circuitry, including a first bipolar transistor which generates a first voltage equivalent to a constant fraction, which is less than unity, of the base-emitter voltage of said first bipolar transistor; and an operational amplifier comprising a pair of bipolar transistors, carrying two different current densities, which are connected to receive said first voltage, and to provide an output which is dependent on said first voltage and is offset corresponding to the difference between the respective base-emitter voltages of said pair of bipolar transistors;

said output of said operational amplifier providing a temperature-independent output.

12. The circuit of claim 11, wherein said first bipolar transistor is pnp.

13. The circuit of claim 11, wherein said first bipolar transistor and said pair of bipolar transistors have a same conductivity type.

14. The circuit of claim 11, wherein said pair of bipolar transistors includes two pnp transistors.

15. A circuit for generating a temperature stable reference voltage, comprising:

circuitry, including a first bipolar transistor, which generates a first voltage equivalent to a constant fraction of the base-emitter voltage of said first bipolar transistor;

an operational amplifier connected to receive said first voltage at a first input terminal, and to provide an output signal which is dependent on both the voltage difference between said first input terminal and a second input and an offset corresponding to the difference between the respective base-emitter voltages of a pair of bipolar transistors carrying two different current densities; said output signal being operatively connected to provide a substantially temperature-independent reference voltage output; and said second input terminal of said operational amplifier being responsive to said output signal.

16. The circuit of claim 15, wherein said first bipolar transistor is pnp.

17. The circuit of claim 15, wherein said first bipolar transistor and said pair of bipolar transistors have a same conductivity type.

18. The circuit of claim 15, wherein said pair of bipolar transistors includes two pnp transistors.

19. A circuit for generating a temperature stable reference voltage, comprising:

a pair of transistors with two different emitter current densities;

circuitry, including an additional bipolar transistor, connected to said pair of transistors, for driving a first one of said pair of transistors with a base drive current proportional to a divided-down fraction of the base-emitter voltage of said additional bipolar transistor;

an amplifying stage which includes said pair of transistors, which amplifies current passed by said first one of said pair of transistors to provide a substantially temperature-independent reference voltage output; and a second one of said pair of transistors being responsive to said output signal.

20. The circuit of claim 19, wherein said additional bipolar transistor is pnp.

21. The circuit of claim 19, wherein said additional bipolar transistor and said pair of bipolar transistors have a same conductivity type.

22. The circuit of claim 19, wherein said pair of bipolar transistors includes two pnp transistors.

* * * * *

UNITED STATES PATENT AND TRADEMARK OFFICE

CERTIFICATE OF CORRECTION

PATENT NO. : 6,307,426 B1
DATED : October 23, 2001
INVENTOR(S) : Giulio Ricotti, Domenico Rossi It is certified that error appears in the above-identified patent and that said Letters Patent is hereby corrected as shown below:

Column 3,
Line 41, delete "12" insert -- I2 --

Column 4,
Line 8, delete "13 and 14" insert -- I3 and I4 --
Line 24, delete "12" insert -- I2 --

Column 5,
Line 13, delete "$\Delta Vbe = Vbe_{Q6} - Vbe_{Q7} = 60\ mV$" insert -- $\Delta Vbe = Vbe_{Q6} - Vbe_{Q7} \approx 60\ mV$ --

Signed and Sealed this

Nineteenth Day of March, 2002

*Attest:*

*Attesting Officer*

JAMES E. ROGAN
*Director of the United States Patent and Trademark Office*